US007735150B2

(12) United States Patent
Wolfe

(10) Patent No.: US 7,735,150 B2
(45) Date of Patent: Jun. 15, 2010

(54) SAFETY HARNESS

(76) Inventor: Dana Wolfe, 724 12th Ave., Manson, IA (US) 50563

( * ) Notice: Subject to any disclaimer, the term of this patent is extended or adjusted under 35 U.S.C. 154(b) by 0 days.

(21) Appl. No.: 11/901,777

(22) Filed: Sep. 19, 2007

(65) Prior Publication Data

US 2009/0070912 A1 Mar. 19, 2009

(51) Int. Cl.
*A41D 13/00* (2006.01)

(52) U.S. Cl. ..... 2/69

(58) Field of Classification Search ..... 2/69, 2/309, 310, 311–318, 327, 338, 94, 456; 182/3–7; 244/151 R, 143
See application file for complete search history.

(56) References Cited

U.S. PATENT DOCUMENTS 5,738,046 A * 4/1998 Williams et al. ..... 119/770
5,960,480 A * 10/1999 Neustater et al. ..... 2/456
6,658,666 B2 * 12/2003 Schweer ..... 2/94

* cited by examiner

*Primary Examiner*—Tejash Patel
(74) *Attorney, Agent, or Firm*—Brett Trout

(57) ABSTRACT

A safety harness system to facilitate attachment and storage of a safety harness. The safety harness is secured to a garment to allow the safety harness to be removed and stored with the garment, thereby preventing entanglement and loss of the safety harness during removal and storage. By securing the safety harness to the garment, the safety harness is less likely to become tangled, lost or damaged during storage.

11 Claims, 7 Drawing Sheets

SAFETY HARNESS

BACKGROUND OF THE INVENTION

1. Field of the Invention

The present invention relates in general to an improved safety harness and, more particularly, to a safety harness releasably secured to a garment.

2. Description of the Prior Art

Safety harnesses are well known in the art. Such harnesses are used by hunters, construction workers, roofers, power line workers and others working at dangerous heights from the ground. Such safety harnesses typically secure around a user's waist and shoulders, and is coupled by a safety line to a tree, a pole, or similar structure to prevent the user from falling in the event the user loses footing. While such safety harnesses have saved hundreds of lives, they do include a drawback.

Prior art safety harnesses typically involve several straps which often become entangled with one another between removal, storage and reattachment to a user. This entanglement not only makes it difficult to secure the safety harness to the user, but also may decrease the effectiveness of the safety harness in the event that the safety harness is secured to the user with tangled lines. Additionally, given the difficulty associated with untangling the lines, and the possibility of losing the safety harness during storage, the user may decide not to use the safety harness, thereby putting the user at risk of death or serious injury. It would, therefore, be desirable to provide a safety harness which was easy to secure and remove from a user, which was easy to store, and which reduced the likelihood of becoming tangled. The difficulties encountered in the prior art discussed hereinabove are substantially eliminated by the present invention.

SUMMARY OF THE INVENTION

In an advantage provided by this invention, a safety harness is provided which is easily secured to a garment.

Advantageously, this invention provides a safety harness which is easily removable from a garment.

Advantageously, this invention provides a safety harness which is secured to a garment in a manner which prevents tangling during storage.

Advantageously, this invention provides a safety harness and garment which may be stored as a unit.

Advantageously, this invention provides a safety harness which may be attached to a garment in a manner which allows the garment to be removed from a user while the safety harness is still attached to the garment.

Advantageously, in the preferred embodiment of this invention, a belt is coupled to a first shoulder harness and a second shoulder harness. Means are coupled to the first shoulder harness and second shoulder harness for coupling the first shoulder harness and second shoulder harness to a garment. In the preferred embodiment, the safety harness is releasably secured to the garment by snaps or the like.

BRIEF DESCRIPTION OF THE DRAWINGS

The present invention will now be described, by way of example, with reference to the accompanying drawings in which.

DETAILED DESCRIPTION OF THE PREFERRED EMBODIMENT

Figure 1:
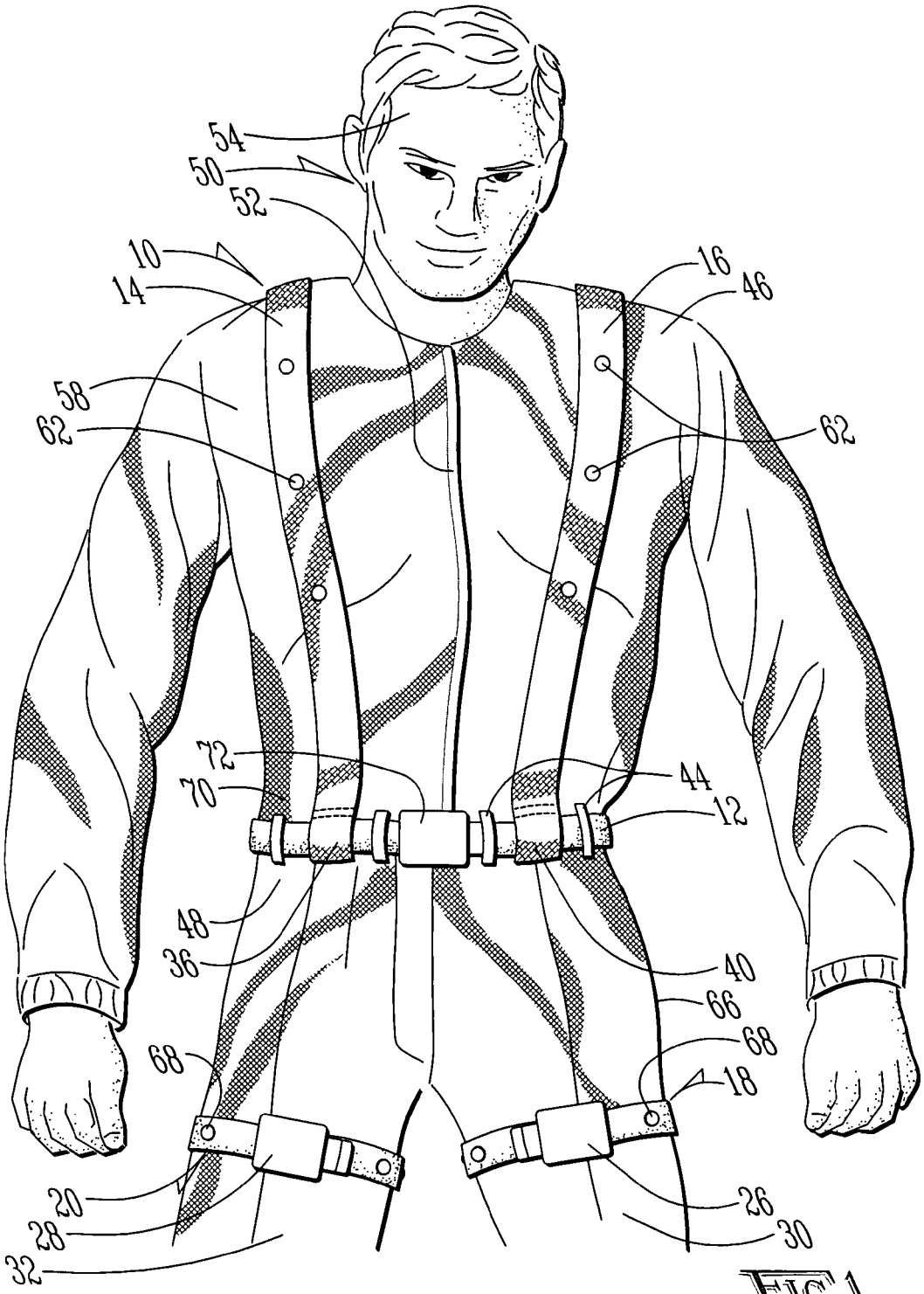
FIG. 1 is a front elevation of the safety harness of the present invention shown secured to a garment provided on a user.

A safety harness according to the present invention is shown generally as (10) in FIG. 1. As shown in FIG. 1, the safety harness includes a belt (12) coupled to a first shoulder harness (14) and a second shoulder harness (16). While in the preferred embodiment the safety harness (10) may be constructed of any suitable material, in the preferred embodiment the seatbelt (10) is constructed of standard seatbelt material, such as 2 ½ inch wide woven nylon and polyester. The safety harness (10) may, of course, be constructed of polypropylene or any desired material. The safety harness (10) is preferably constructed for the suspension of at least a one hundred kilogram user, but may be constructed of dimensions suitable for any desired size user.

Figure 2:
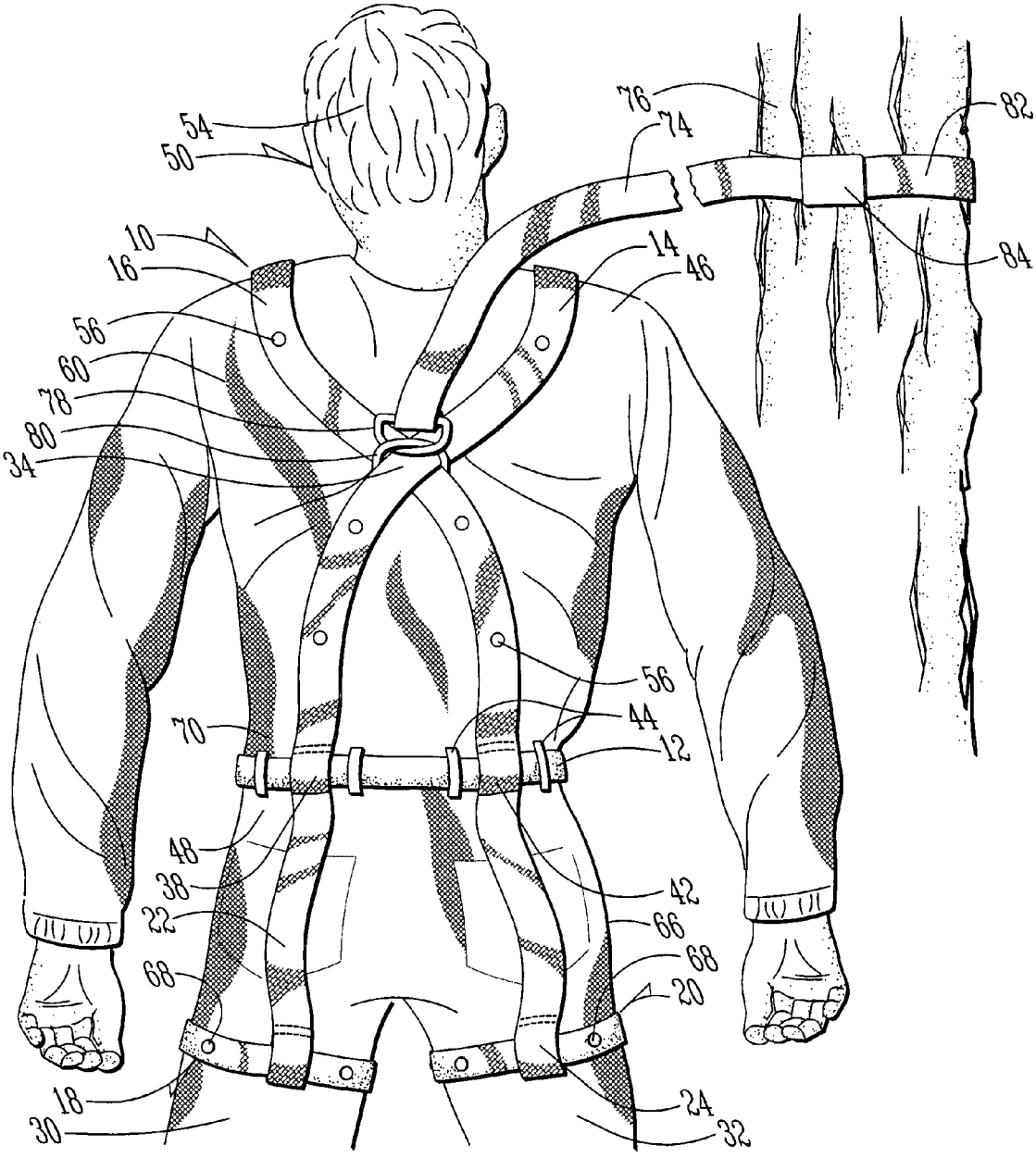
FIG. 2 illustrates a rear elevation of the safety harness of the FIG. 1, shown with the safety harness attached to a tree by a safety line.

As shown in FIG. 2, the safety harness (10) includes a first leg restraint (18) and a second leg restraint (20) coupled to a first connection strap (22) and a second connection strap (24) looped around the belt (12). As shown in FIG. 1, the first leg restraint (18) is provided with a first buckle (26) and the second leg restraint (10) is provided with a second buckle (28), such as those known in the art for securing prior art safety harnesses. Alternatively, the leg restraints (18) and (20) may be simply annular pieces of seatbelt material into which the user (50) slides his or her legs (30) and (32).

The first shoulder harness (14) is provided on each end with a loop (36) and (38), sized to accommodate the belt (12). Similarly, the second shoulder harness (16) is provided on each end with a loop (40) and (42), to allow the belt (12) to be provided therethrough and secured thereto. As shown in FIGS. 1 and 2, the belt (12) is provided through a plurality of belt loops (44) provided on a garment (46). While the garment (46) may, of course, be any suitable garment known in the art, in the preferred embodiment the garment (46) is preferably a heavy, cotton or polyester jacket with a length sufficient to locate the belt loops (44) at the waist (48) of the user (50). Preferably, the garment (46) is provided with a zipper (52), or similar means known in the art, to allow easy removal of the garment (46) from the user (50). Alternatively, the garment (46) may be of a "pullover" design, which the user (50) may remove by pulling the garment (46) off over the user's head (54).

Figure 3:
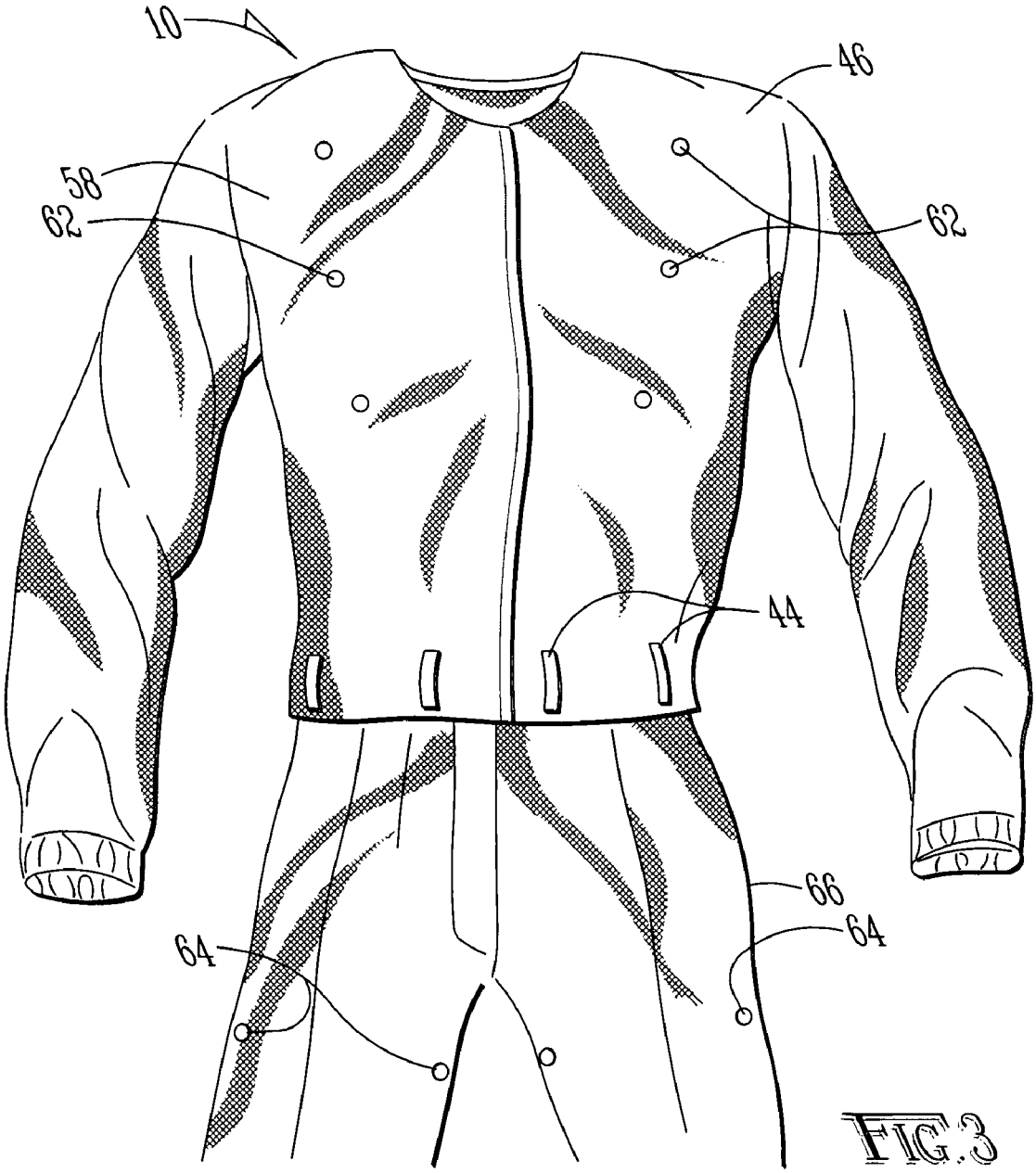
FIG. 3 illustrates a front elevation of the garment shown with the safety harness removed.
Figure 4:
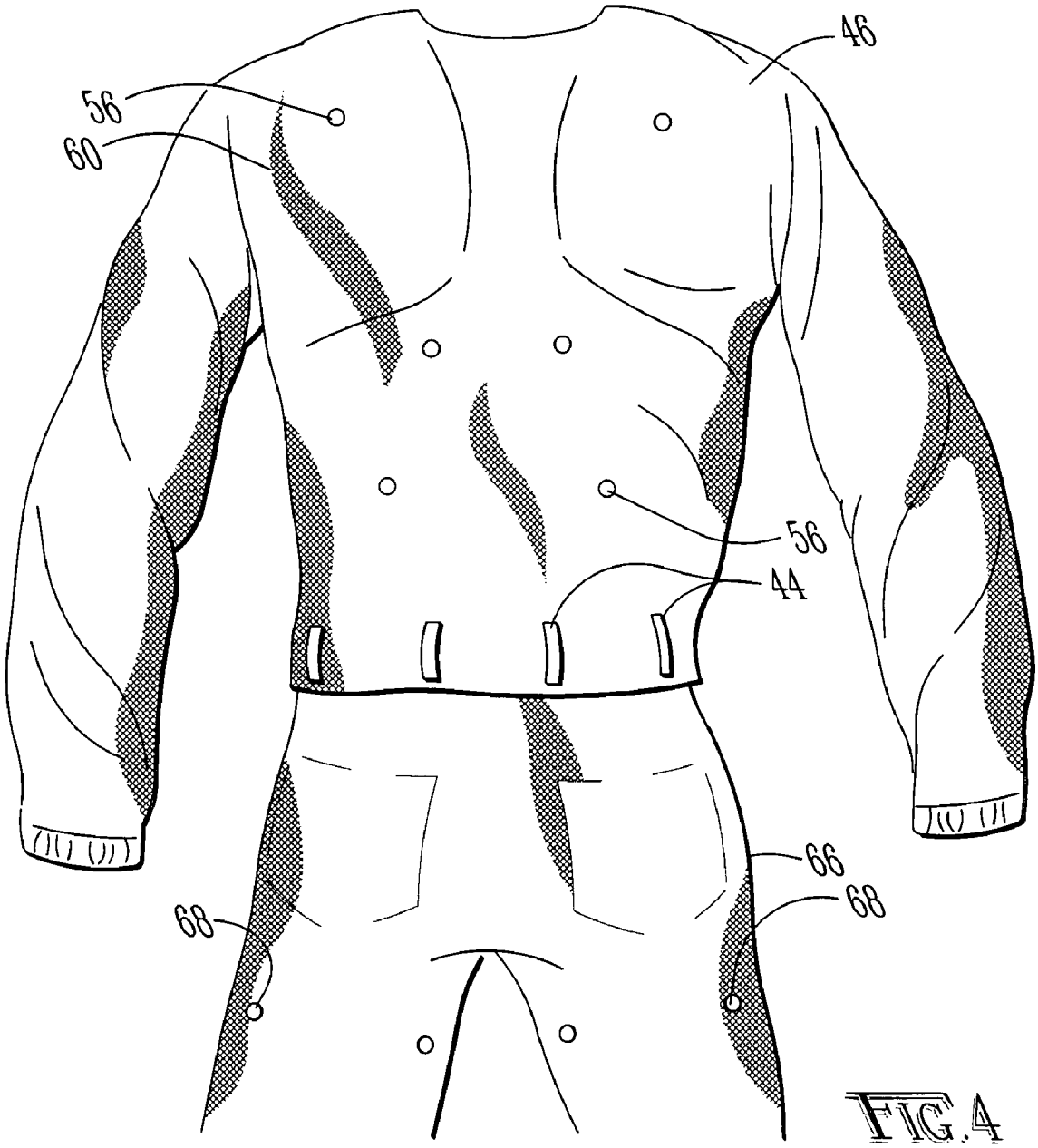
FIG. 4 illustrates a rear elevation of the garment of FIG. 1, shown with the safety harness removed.

As shown in FIGS. 3 and 4, the garment (46) is provided with a plurality of snaps (56). The snaps (56) are preferably provided both on the front (58) and back (60) of the garment (46) at points where the safety harness (10) is provided over the garment (46). While any desired number of snaps (56) may be provided, in the preferred embodiment, six snaps are provided on the front (58) of the garment (46) to secure the fronts of the shoulder harnesses (14) and (16) to the front (58) of the garment (46), and six snaps (56) are provided on the back (60) of the garment (46) to secure the shoulder harnesses (14) and (16) to the back (60) of the garment (46). If desired, any suitable number or positioning of the snaps (56) may be used.

As shown in FIGS. 1 and 2, the first shoulder harness (14) and second shoulder harness (16) are also provided with a plurality of snaps (62) to secure the first shoulder harness (14) and second shoulder harness (16) to the garment (46). When it is desired to secure the safety harness (10) to the garment (46), the first shoulder harness (14) and second shoulder harness (16) are positioned over the garment (46) and the corresponding snaps (56) and (62) are secured to one another to secure the first shoulder harness (14) and second shoulder harness (16) to the garment (46). Once the shoulder harnesses (14) and (16) are secured, the belt (12) is provided through the belt loops (44) provided on the garment (46). The belt (12) is preferably secured through the loops (36), (38), (40) and (42) associated with the shoulder harnesses (14) and (16).

If desired, as shown in FIGS. 3 and 4, snaps (64) may be provided on pants (66) to correspond with snaps (68) provided on the leg restraints (18) and (20). The snaps (68) on the leg restrains (18) and (20) may be secured to the snaps (64) on the pants (66). The snap connection of the leg restrains (18) and (20) to the pants (66) are especially desirable when the pants (66) are integral with the garment (46), such as the case with overalls and the like. In a situation where the pants (66) are not integrally formed with the garment (46), it may be desirable to avoid snapping the leg restraints (18) and (20) to the pants (66) to facilitate the pants (66) being placed on and removed from the user (50).

When it is desired to utilize the safety harness (10) of the present invention, the user (50) puts on the garment (46) and snaps the first shoulder harness (14) and second shoulder harness (16) to the garment (46) using the snaps (56) and (62). Once the shoulder harnesses (14) and (16) have been secured to the garment (46), the user (50) threads the belt (12) through the belt loops (44), also securing the belt (12) through the loops (36), (38), (40) and (42) of the first shoulder harness (14) and second shoulder harness (16). The belt (12) is then secured around the waist (70) of the user (50) by a buckle (72), such as those well known in the art. If the garment (46) is integrally formed with the pants (66), the user (50) then secures the leg restrains (18) and (20) to the pants (66) with the snaps (64) and (68). Alternatively, if the pants (66) are not formed integral with the garment (46), the leg restrains (18) and (20) may be allowed to hang loose.

Once the pants (66) have been placed on the user (50), the leg restraints (18) and (20) are secured around the user's legs (30) and (32), and secured thereto by the buckles (26) and (28). The user (50) then moves to the desired location above the ground and secures a safety line (74) to a tree (76), or other solid structure. In the preferred embodiment, the safety line (74) is secured to the safety harness (10) by a first metal "D" ring (78) secured through a sewn metal loop at the end of the safety line (74) to another "D" ring (80) secured to a sewn woven loop coupled to the overlap (34) between the first shoulder harness (14) and second shoulder harness (16). The safety line (74) may, of course, be coupled to the safety harness (10) by any suitable means known in the art. The safety line (74) is preferably coupled to the tree (76) by a loop (82) of woven seatbelt material provided with an adjustable buckle (84) to allow the loop (82) to accommodate trees (76) of various diameters.

When it is desired to remove the garment (46) from the user (50), the buckles (26) and (28) of the leg restraints (18) and (20) are unbuckled and the garment (46) unzipped. The buckle (72) of the belt (12) is then unbuckled and the garment (46) is removed from the user (50) with the safety harness (10) still attached by the snaps (56) and (62). If the garment (46) is integrally coupled to the pants (66), the safety harness (10) remains coupled to the safety harness (10) by the snaps (64) and (68) as well. The safety harness (10) thereafter may be stored with the garment (46) for later use. When it is desired to later use the safety harness (10), the user (50) simply puts on the garment (46) and secures the belt buckles (26), (28) and (72).

Figure 5:
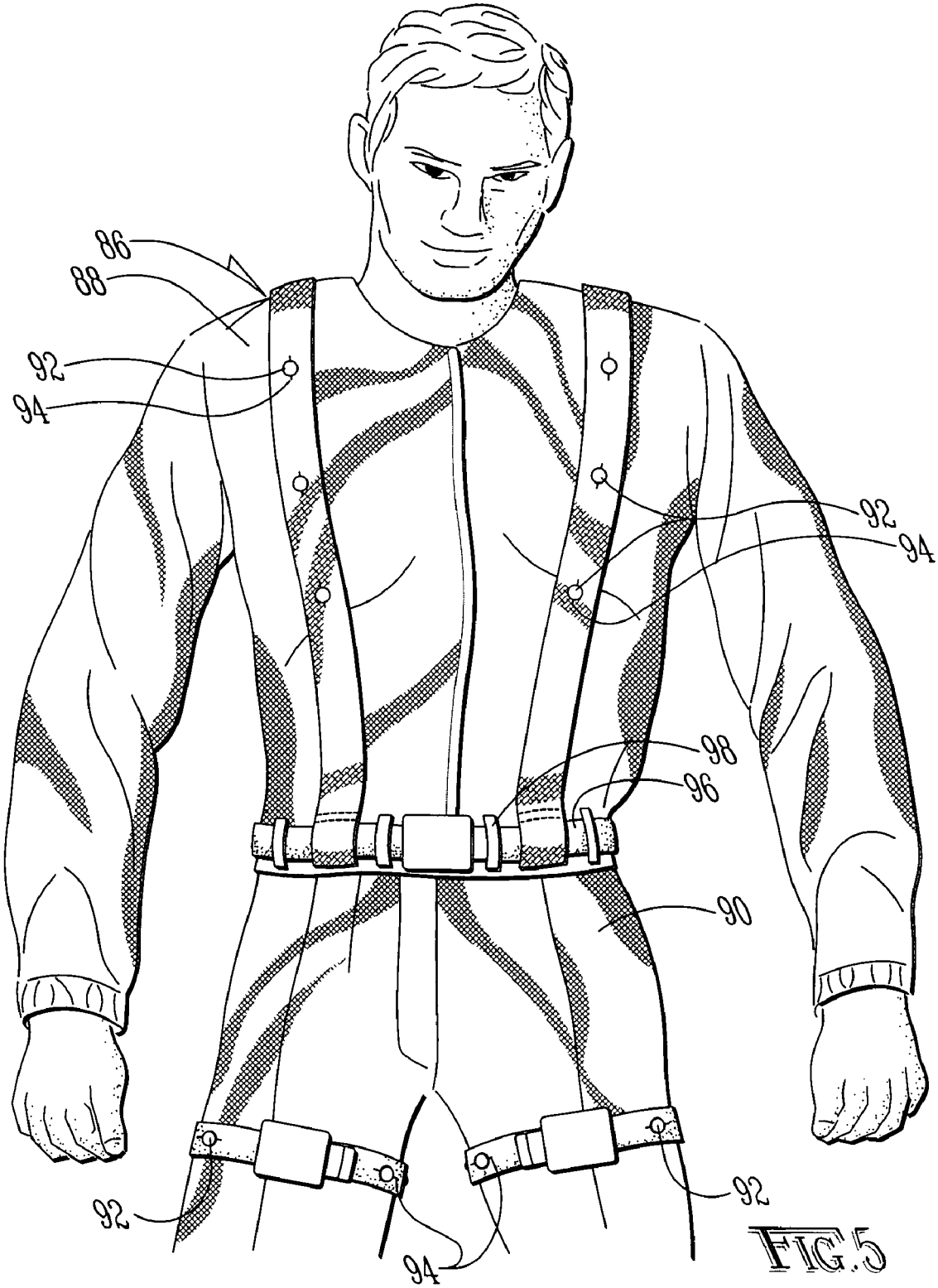
FIG. 5 illustrates a front elevation of an alternative embodiment of the present invention, showing the safety harness coupled to a garment by buttons.

An alternative embodiment of the present invention is shown generally as (86) in FIG. 5. The alternative safety harness (86) is secured to a garment (88) and pants (90) by a plurality of buttons (92) through buttonholes (94) provided in the safety harness (86). The safety harness (86) is provided with a belt (96), similar to that described above and secured to the garment (88) by belt loops (98).

Figure 6:
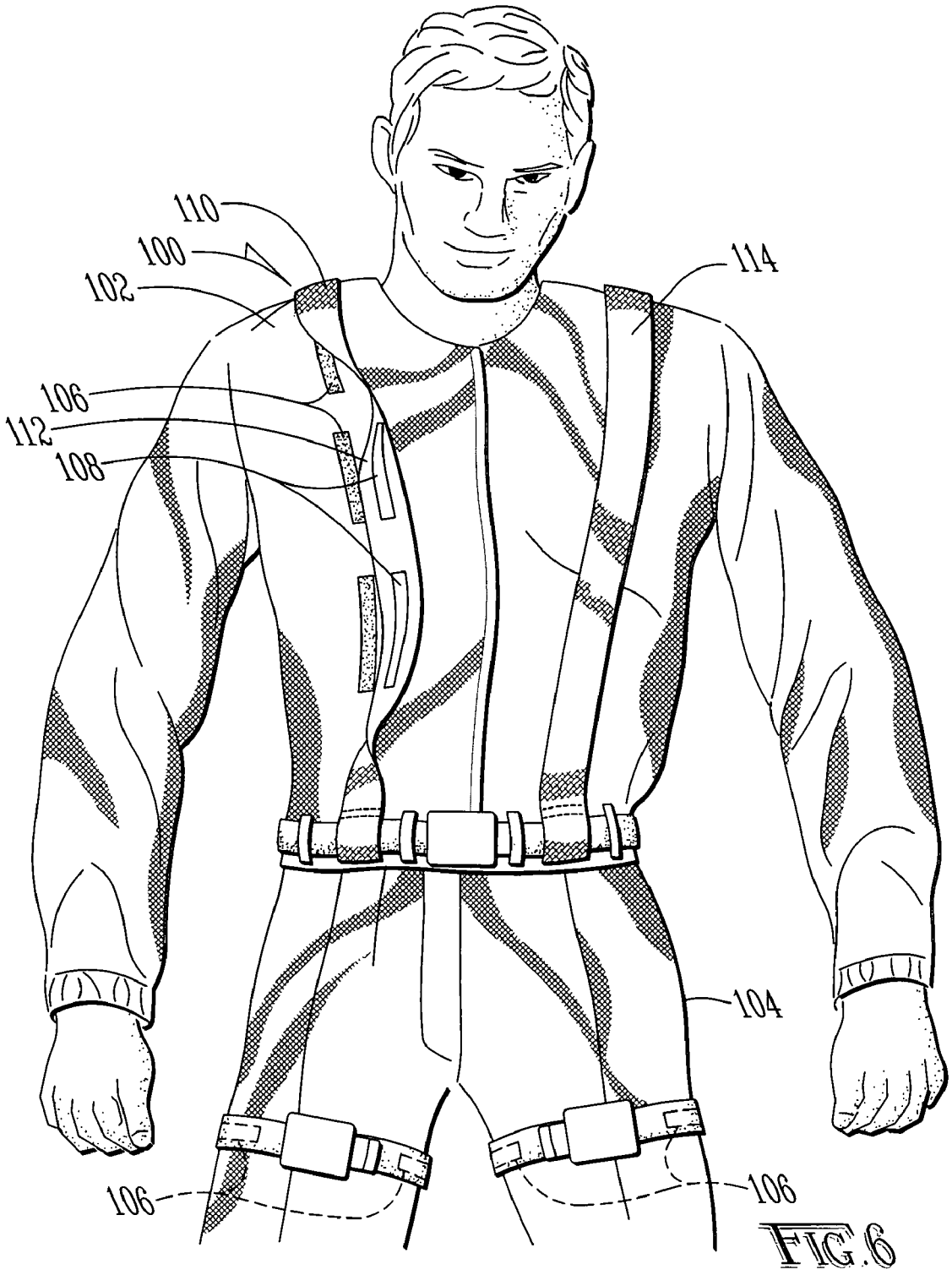
FIG. 6 illustrates a front elevation of an alternative embodiment of the present invention, shown with the safety harness being attached to a garment with hook and latch material.

In another alternative embodiment, the present invention is shown generally as (100) in FIG. 6. The alternative safety harness (100) is secured to a garment (102) and pants (104) by hook and latch material (106) coupled to the garment (102) and pants (104) and hook and latch material (108) secured to the safety harness (100). As shown in FIG. 6, the first shoulder harness (110) is secured to the garment (102) by placing the underside (112) of the first shoulder harness (110) on top of the hook and latch material (106) provided on the garment (102). As shown in FIG. 6, the second shoulder harness (114) is positioned over the hook and latch material (106). The hook and latch material (106) is covered by the second shoulder harness (114).

Figure 7:
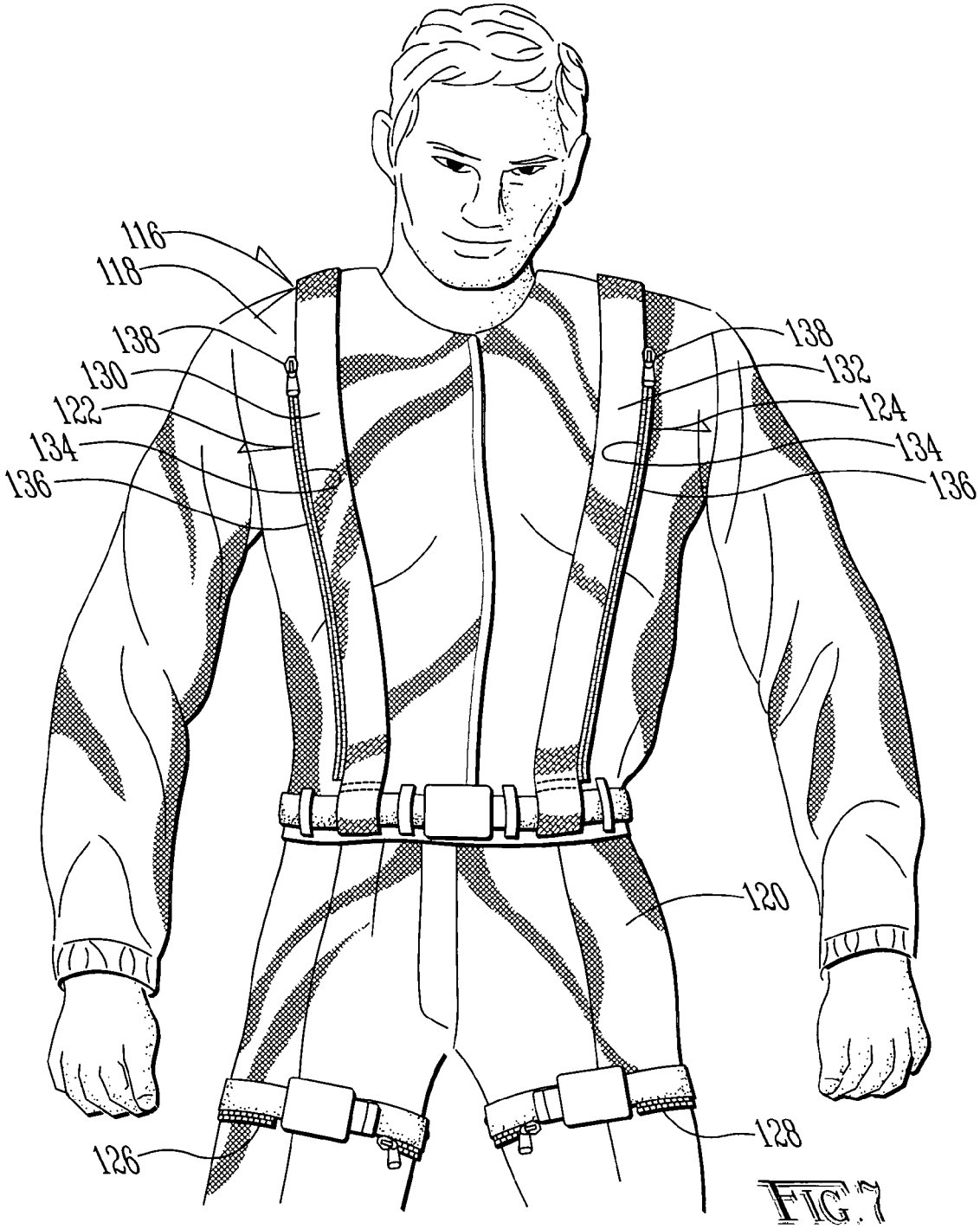
FIG. 7 illustrates a front elevation of an alternative embodiment of the present invention, shown with the safety harness zippered to a garment.

In another alternative embodiment, the present invention is shown generally as (116) in FIG. 7. The shoulder harness (116) is secured to a garment (118) and pants (120) by a plurality of zippers (122), (124), (126) and (128). If desired, the zippers (122) and (124) may be provided along the front of the first shoulder harness (130) and second shoulder harness (132), or may be provided across the front and back of the shoulder harnesses (130) and (132). Preferably, a first row of teeth (134) is provided along the shoulder harnesses (130) and (132), and a second set of teeth (136) is secured to the garment (118) to allow the handle (138) of the zipper to mesh the sets of teeth (134) and (136) and secure the shoulder harnesses (114) and (116) to the garment (118).

Although the invention has been described with respect to a preferred embodiment thereof, it is to be understood that it is not to be so limited since changes and modifications can be made therein which are within the full, intended scope of this invention as defined by the appended claims.

What is claimed is:

1. A safety harness comprising:

(a) a waist belt;

(b) a first shoulder harness operably coupled to said belt;

(c) a second shoulder harness operably coupled to said belt;

(d) a first leg harness operably coupled to said first shoulder harness;

(e) a second leg harness operably coupled to said second shoulder harness;

(f) a safety line operably coupled to said first shoulder harness;

(g) a jacket defining an interior surface and an exterior surface;

(h) pants defining an interior surface and an exterior surface;

(i) a first fastener coupled to said exterior surface of said jacket;

(j) wherein said first fastener secures said first shoulder harness against movement relative to said jacket;

(k) a second fastener coupled to said exterior surface of said jacket;

(l) wherein said second fastener secures said second shoulder harness against movement relative to said jacket;

(m) a third fastener coupled to said exterior surface of said pants;

(n) wherein said third fastener secures said first leg harness to said pants against movement relative thereto;

(o) a fourth fastener coupled to said exterior surface of said pants; and (p) wherein said fourth fastener secures said second leg harness to said pants against movement relative thereto.

2. The safety harness of claim 1, further comprising a belt loop coupled to said exterior surface of said jacket.

3. The safety harness of claim 2, wherein said jacket is secured to said pants.

4. The safety harness of claim 1, further comprising at least five supplemental fasteners coupled to said exterior of said jacket.

5. The safety harness of claim 1, wherein said jacket and said pants are not integral with one another.

6. The safety harness of claim 1, further comprising a belt coupled to said first shoulder harness, said second shoulder harness and to said exterior surface of said jacket.

7. The safety harness of claim 1, wherein said first fastener is latch material.

8. The safety harness of claim 1, wherein said first fastener is a button.

9. The safety harness of claim 1, wherein said first fastener is hook material.

10. The safety harness of claim 1, wherein said first fastener is loop material.

11. The safety harness of claim 1, wherein said first fastener is a plurality of zipper teeth.

* * * * *